US006206244B1

(12) United States Patent
Mühlbauer

(10) Patent No.: US 6,206,244 B1
(45) Date of Patent: Mar. 27, 2001

(54) DEVICE FOR SQUEEZING FLOWABLE MATERIAL OUT OF A TUBULAR BAG

(75) Inventor: Ernst Mühlbauer, Hamburg (DE)

(73) Assignee: Wolfgang Muhlbauer, Hamburg (DE)

( * ) Notice: Subject to any disclaimer, the term of this patent is extended or adjusted under 35 U.S.C. 154(b) by 0 days.

(21) Appl. No.: 09/230,812

(22) PCT Filed: Aug. 8, 1997

(86) PCT No.: PCT/EP97/04338

§ 371 Date: Jul. 22, 1999

§ 102(e) Date: Jul. 22, 1999

(87) PCT Pub. No.: WO98/06506

PCT Pub. Date: Feb. 19, 1998

(30) Foreign Application Priority Data

| | | |
|---|---|---|
| Aug. 12, 1996 | (DE) | 296 13 945 U |
| Oct. 10, 1996 | (DE) | 296 17 654 U |
| Apr. 29, 1997 | (DE) | 297 07 761 U |
| May 28, 1997 | (DE) | 297 09 408 U |

(51) Int. Cl.[7] ..... B65D 35/56
(52) U.S. Cl. ..... 222/105

(58) Field of Search ..... 222/94, 95, 105, 222/325, 326, 327, 386

(56) References Cited

U.S. PATENT DOCUMENTS

| | | | | |
|---|---|---|---|---|
| 5,332,122 | * | 7/1994 | Herold et al. | 222/105 |
| 5,407,093 | | 4/1995 | McGill | 220/666 |
| 5,419,460 | * | 5/1995 | Herold et al. | 222/105 |
| 5,505,339 | * | 4/1996 | Cowger et al. | 222/105 |

FOREIGN PATENT DOCUMENTS 2 301 306 9/1976 (FR) .

* cited by examiner

*Primary Examiner*—Philippe Derakshani
*Assistant Examiner*—Thach H Bui
(74) *Attorney, Agent, or Firm*—Alix, Yale & Ristas, LLP

(57) ABSTRACT

The inventive device for squeezing flowable material includes a tubular bag containing the material, as well as an injection device . The tubular bag is inserted into a cylindrical chamber of the ejection device. Its open end is located inside an outflow opening of said device. The tubular bag is clamped to the fore-part with a sealing washer, the clamping member of which cooperates exclusively with the outflow opening edge formed by the fore-part.

16 Claims, 4 Drawing Sheets

DEVICE FOR SQUEEZING FLOWABLE MATERIAL OUT OF A TUBULAR BAG

CROSS-REFERENCE TO RELATED APPLICATIONS

This is the national stage of International Application No. PCT/EP97/04338 filed Aug. 8, 1997.

BACKGROUND OF THE INVENTION

It is known to squeeze a free-flowing, pasty mass, such as a sealing compound or dental impression mass, out of a tubular bag by the latter being put into a cylinder space which is acted upon from one end by a piston and has a discharge opening or delivery nozzle at the other end, at which the bag is open. In this case, it is particularly important that that end of the tubular bag which contains the bag opening is sealed off from that end of the cylinder space and of the delivery nozzle which forms the discharge opening. If, for this purpose, the tubular bag is firmly connected to the device forming the cylinder space (FR-A 1 161 905), repeated use of the squeezing-out device for a plurality of tubular bags is made impossible. If the tubular bag is connected to the delivery nozzle in one piece or via thread (DE-A 35 00 625), the exchange of the tubular bag is prevented or made more difficult, provided the nozzle is also not designed as a throw-away part. The latter is often not possible or is undesirable. The arrangement of sealing elements between the end of the tubular bag and the delivery nozzle or discharge opening (EP-A 319 666), which sealing elements are to be fixed by special clamping or screw parts, also makes exchange difficult. To avoid these disadvantages, the arrangement mentioned in the preamble of claim 1 for squeezing out interchangeable tubular bags has been disclosed (EP-A 541 972), in which the gathered-up end, forming the bag opening, of the tubular bag is firmly connected to a sealing ring, which has a conical sealing surface, which interacts with a correspondingly conical sealing surface in the discharge opening of the squeezing-out device. Under the action of the squeezing-out piston, the cone of the sealing ring is pressed into the conical discharge opening, provided it is adequately centred beforehand. In the event of inadequate centring, sealing is not achieved. If the cone of the sealing ring sits in an exactly centred manner in the discharge opening, it appears possible to achieve an adequate sealing effect as long as the effect of the piston force continues. However, this sealing effect ceases when the arrangement "breathes" if the piston force ceases. Since, during the squeezing-out, most of the pressure drop does not take place in the bag opening or the discharge opening of the squeezing-out device but in the downstream spaces of the nozzle and the mixing device which is possibly present, a considerable pressure, which leads to corresponding extension of the associated walls, builds up during the squeezing-out in these spaces downstream of the discharge opening. If the squeezing-out force of the piston ceases, this extension leads to a back pressure and a backflow of the mass in the region of the discharge opening. As a result, the cone of the sealing ring may be lifted from its conical seat in the discharge opening; the sealing gap opens and the mass can penetrate into the space, to be sealed off, between the sealing ring and the tubular bag on the one hand and the cylinder space on the other hand. The mutual centring may also be lost, so that the cone of the sealing ring is not returned into the correct seat when pressure is next applied. Contamination of the device cannot therefore be completely avoided by the known arrangement. In addition, there is the disadvantage that the discharge opening has to be carefully cleaned when the tubular bag is changed, since otherwise possibly consolidated residues of the mass which remain there make complete sealing impossible even during the effect of the squeezing-out force, a factor which then leads to further contamination of the device. The known type of sealing also requires careful production and assembly of the parts which are involved in the sealing, and this is expensive. It is known (EP-A-663348) to counteract these disadvantages by the ring which bears the cone having a rim diameter which exceeds the inside diameter of the cylinder space accommodating the tubular bag and by said ring being fixed in a circumferential groove, which is formed between the end of the wall of the cylinder space and a lid forming the delivery nozzle. However, this has the disadvantage that the tubular bag can only be used in such devices whose cylinder space contains said circumferential groove and has a lid on the delivery side, the lid having to be opened in order to insert the tubular bag.

SUMMARY OF THE INVENTION

The object of the invention is to provide an arrangement for squeezing a free-flowing substance out of an elongated tubular bag which is less expensive, permits easy exchange of the tubular bag, and nonetheless ensures adequate sealing.

The effect of the sealing elements of the sealing ring solely on the end face surrounding the discharge opening or on that edge of the discharge opening which is formed by this end face makes careful cleaning of the discharge opening, to which access is more difficult, unnecessary. Cleaning of the end face is also frequently unnecessary, since experience shows that the mass rarely penetrates so far. In the region of the edge, any residues of the mass are displaced without impairing the sealing effect. The interacting sealing surfaces impose a smaller requirement for accurate production and assembly, since it is not necessary to exactly match any diameters to one another. Finally, the invention has the advantage that the sealing is independent of the respective design of the discharge opening, and the tubular bags can therefore be used in different squeezing-out devices. The sealing effect also cannot be impaired by any inclination of the sealing ring.

In general, the end face surrounding the discharge opening of the squeezing-out device is flat. It is then advisable to also design the sealing ring (apart from projecting sealing elements) to be flat, so that it can extend parallel to the end face. This especially applies when, according to a further feature of the invention, it has an outside diameter approximately equal to the diameter of the cylinder space. As a result, effective guidance and centring of the tubular bag end is obtained during insertion into the delivery opening. Furthermore, it is advantageous if the rim of the sealing ring has a considerable height, which prevents the canting of the sealing ring when the tubular bag is being inserted into the cylinder space from its rear side remote from the delivery side. This height is preferably at least 4 mm or 6% (better 10%) of the diameter. Furthermore, it may be expedient if the circumferential surface is entirely or partly conical or bevelled or rounded off at one or both edges in order to facilitate the insertion into the cylinder space and if need be to also avoid the canting.

In order to avoid the lifting of the sealing elements from the end face of the cylinder space, the sealing ring, according to a further feature of the invention, may be provided with a retaining part arresting it in the sealing position. The invention prefers two embodiments of this idea. The first is distinguished by the fact that the retaining part is designed as a clamp interacting with the inner wall of the cylinder space. This is preferably achieved by the disc which forms or retains the sealing ring being flexible and by its outside diameter being slightly larger than the inside diameter of the cylinder space. If the disc is pushed against the end face during the squeezing-out activity of the piston, its outer rim, which bears under deformation against the inner surface of the cylinder space, bends slightly rearwards, the angle between this rim and the normal to the cylinder wall being so small in longitudinal section that self-locking takes place. This means that the disc is secured in the position which it thus attains. It cannot give way if the piston force ceases, and the sealing elements remain pressed against the end face under the elastic force of the disc deformation. In this way, the breathing is prevented. In the second embodiment of the retaining part, the disc is provided with a suction holder which holds it in place on the end face. This may involve one or more suction cups.

According to a further feature of the invention, a brake element, which secures the bag in the respective position in the cylinder space, is arranged on the rear end of the tubular bag. By friction, it also prevents the bag from slipping rearwards or even falling out of the cylinder upon withdrawal and when the cylinder is placed in the vertical position with the outlet opening at the top. Owing to the fact that the draw-in force, when the bag is being pushed into the cylinder space, is exerted directly on the brake element arranged on the rear tubular bag end, it need not be transmitted to the brake element via the bag and its contents and therefore does not have an effect on the internal pressure of the bag.

BRIEF DESCRIPTION OF THE DRAWINGS

The invention is explained in more detail below with reference to the drawing, which illustrates advantageous exemplary embodiments and in which.

DETAILED DESCRIPTION OF THE PREFERRED EMBODIMENT

Figure 1:
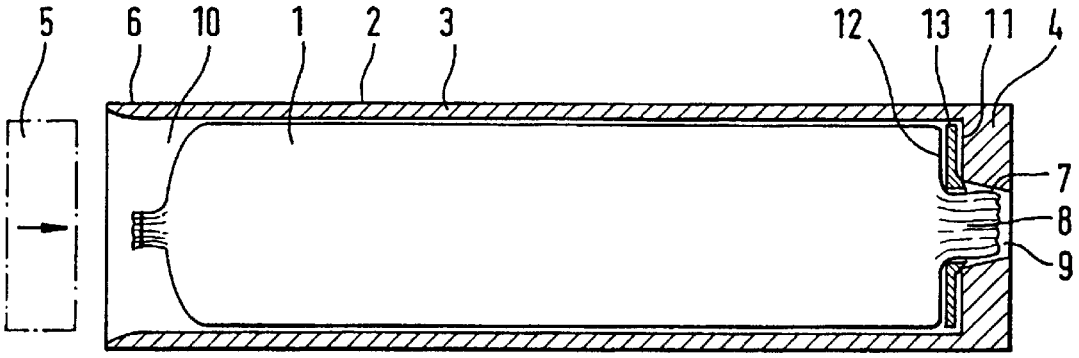
FIG. 1 shows a schematic longitudinal section through a cartridge containing the tubular bag.

FIG. 1 shows the tubular bag 1 inside a so-called cartridge 2, which comprises a wall 3 and a base 4. Its inside diameter is dimensioned to suit the tubular bag 1. Cartridges of this type with tubular bags are used as interchangeable inserts in devices for delivering plastic masses, for example in devices for delivering dental multi-component impression masses (EP-A 492 413).

The cartridges are inserted into the device in such a way that a piston 5 specific to the device can penetrate in the direction of the arrow into the open end 6, remote from the base, of the cartridge in order to squeeze out the tubular bag 1. The gathered-up end 7, which is closed in the storage state, of the bag at the other end is cut off in such a way that a bag opening 8 forms, and this bag opening 8 opens into a discharge opening 9 located in the base 4 of the cartridge. A sealing ring 13 is inserted between that end face 11 of the base 4 which faces the cylinder space 10 of the cartridge and the shoulder surface 12 of the tubular bag 1. When the piston 5 compresses the tubular bag 1, the mass contained therein can flow through the bag opening 8 and the discharge opening 9 into the downstream spaces (not shown) of the device in order to be mixed, for example, with another component and finally delivered in the desired manner. The pressure produced in the tubular bag 1 by the piston also acts via the shoulder surface 12 on the sealing ring 13, so that the latter, at least during the squeezing-out operation, forms an effective seal between the end face 11 and the shoulder surface 12. In addition, the gathered-up portion 7 is pressed against the wall surface of the discharge opening 9, so that an upstream seal is obtained at this point. The term cylinder space is not intended to imply that the wall 3 has to be cylindrical; however, it is expediently cylindrical.

It is assumed in FIG. 1 that the base 4 of the cartridge is firmly connected to its wall 3 and the tubular bag 1 is inserted into the cartridge from the side remote from the delivery side. However, embodiments in which the base can be released from the wall 3 like a lid in order to insert the tubular bag 1 are also possible.

Figure 2:
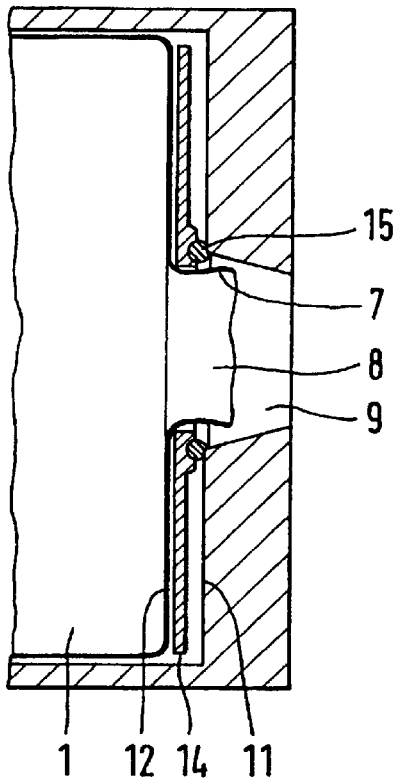
FIGS. 2 to 4 show partial sections through the base region of the cartridge with different sealing rings.

In the embodiment of the sealing ring shown in FIG. 2, this sealing ring is designed as an annular disc 14. It may be adhesively bonded to the shoulder surface 12 of the tubular bag 1. Its outside diameter is not much smaller than that of the cylinder space 10. It can therefore serve to centre the bag opening relative to the discharge opening when the tubular bag is inserted into the cartridge. It is made of rigid plastic in order to be able to perform this task. It also expediently has such a high strength that it can ensure that the annular disc 14 is in an approximately flat position or a position parallel to the end face 11.

Close to the inner rim of the annular disc 14, an O-ring 15 (there may also be a plurality of O-rings) is connected in a leakproof and preferably firm manner to the annular disc 14 by virtue of the fact that said O-ring 15 is adhesively bonded in place or is clamped in place in an annular groove, for example. It is made of soft rubber or foam rubber with a closed surface and therefore bears without gaps against the end face 11 under the pressure acting during the squeezing-out operation and thus forms effective protection against the penetration of mass from the discharge opening 9 if mass should pass through between the gathered-up portion 7 and the wall of the discharge opening 9. The O-ring 15 is moved so close up to the discharge opening 9 that it interacts with the edge of the latter, as a result of which the sealing effect is improved.

Since the bag opening 8 can have a larger inside diameter than known tubular bags due to the absence of an annular part penetrating into the discharge opening 9, its flow resistance is low, so that the degree of "breathing" and thus the risk of the ingress of the mass between the gathered-up portion 7 of the tubular bag and the wall of the discharge opening 9 are less than in the case of known arrangements. The annular disc 14, as shown in FIG. 4, may be provided with a raised rim 27.

If the deformed bag 1 is inserted into the cylinder 3 in a careless manner, the end face of the bag may be skewed slightly. The corresponding inclination of the end face is transmitted to the sealing ring if the latter is designed as a disc or is connected to a disc which is adhesively bonded over the full area to the end face of the bag. The tightness may suffer from this in the embodiment according to FIG. 2 but not in the embodiments according to FIGS. 3 and 4.

Figure 3:
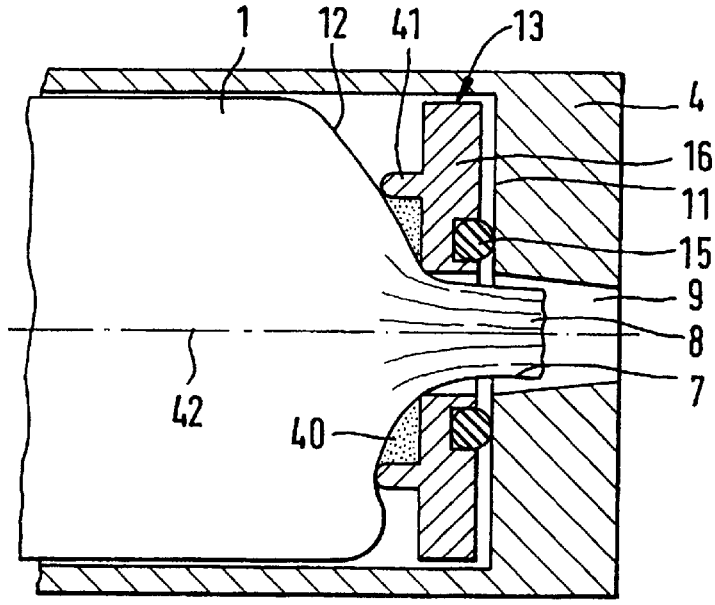

FIG. 3 shows that the sealing ring, designated overall by the reference numeral 13, consists of a disc 16 having a circumferential surface 28, and an elastomeric O-ring 15, which is secured in a groove of the disc 16 and interacts in a sealing manner with the end face 11 of the cartridge base 4. The disc 16 is connected to the end face 12 of the bag 1 by an adhesive and sealing compound 40. The connection is restricted to the radially inner region of the disc 16 and the end face 12 and is limited on the outside by a bead 41, which is provided in an annular manner concentrically to the disc opening and to the disc circumference on that end face of the disc 16 which faces the bag 1. Outside the annular bead 41, the disc 16 and the bag end face 12 are not connected and are generally removed from one another slightly. The disc 16 is therefore able to tilt freely within a certain angular range relative to the bag end face 12, the bead 41 being pressed more on one side and less on the other side into the bag. Any inclination of the bag, as indicated in FIG. 2, is therefore unable to have an effect on the position of the disc 16 and on the sealing effect of the O-ring 15.

Figure 4:
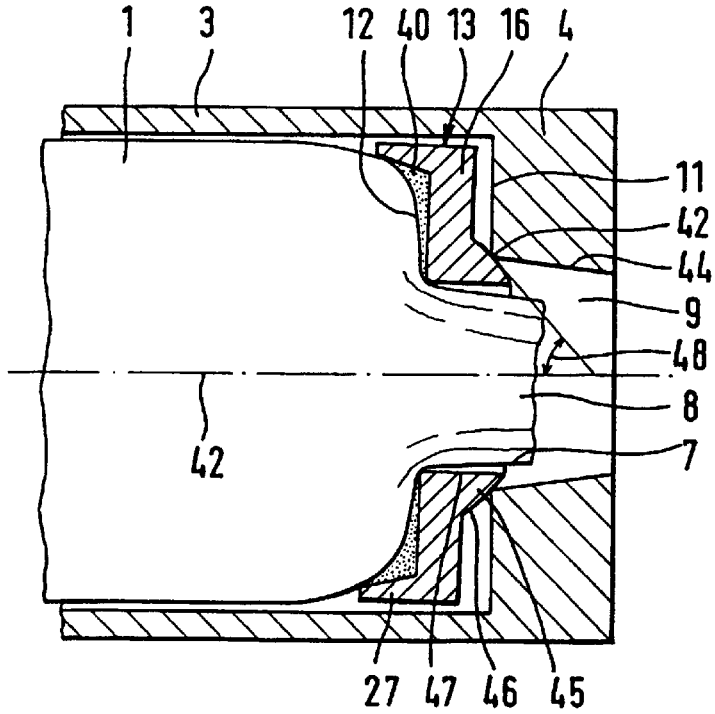

In the embodiment according to FIG. 4, the end face 12 of the bag 1 is connected to the disc 16 of the sealing ring 13 essentially over the full area by means of the adhesive compound 40, so that the disc 16, as indicated in the drawing, participates in any deformation of the bag caused by inclination. However, this cannot lead to a lack of tightness, since the sealing element of the sealing ring 13 is formed by a centric projection 45 having a spherical surface 46. The projection surrounds an opening 47, through which the plait 7, which forms the bag opening 8, projects. The spherical surface 46 forms the sealing surface on the bag side.

The mating sealing surface is formed by the edge 43, which is obtained on the base 4 of the cartridge at the transition between the end face 11 and its delivery opening 9. The edge 43 lies in the plane of the face 11 and is circular. Its diameter is less than the outside diameter of the spherical projection 45. Therefore the edge 43 is able to provide a seal on the spherical sealing surface 46 along a closed encircling sealing line. A similar effect is achieved if the sealing surface is conical, provided its cone angle is more obtuse than that of a wall 44, if need be of conical design, of the discharge opening 9.

The diameter of curvature of the spherical sealing surface 46 is considerably larger than the diameter of the sealing edge 43, so that wedging of the spherical sealing surface in the edge 43 or the wall 44 of the opening 9 cannot take place. The tangent at a contact point between the spherical sealing surface 46 and the sealing edge 43 forms with the axis of the sealing edge 43 an angle which is expediently greater than 30° and furthermore expediently greater than 40°. However, the angle should be less than 60°, so that the projection 45 is centred automatically relative to the edge 43. The same correspondingly applies to a conical form of the projection 45.

This embodiment not only has the advantage of insensitivity to inclination of the sealing ring but also leads to especially reliable sealing, since the sealing pressure against the edge 43 is high and any contaminants are squeezed out of the way.

Figure 6:
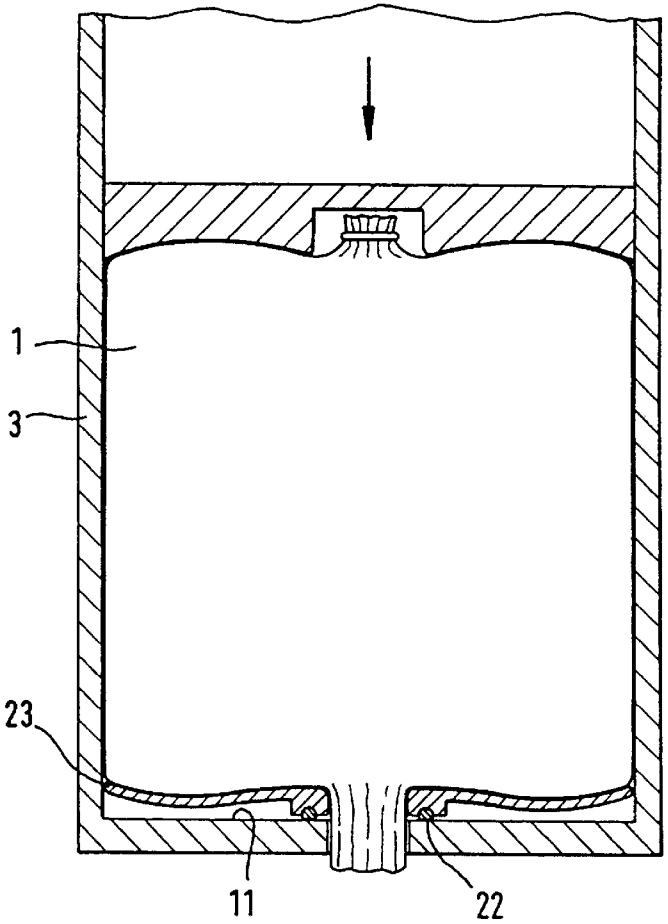
FIGS. 5 and 6 show longitudinal sections through a further embodiment in two different functional positions.
Figure 5:
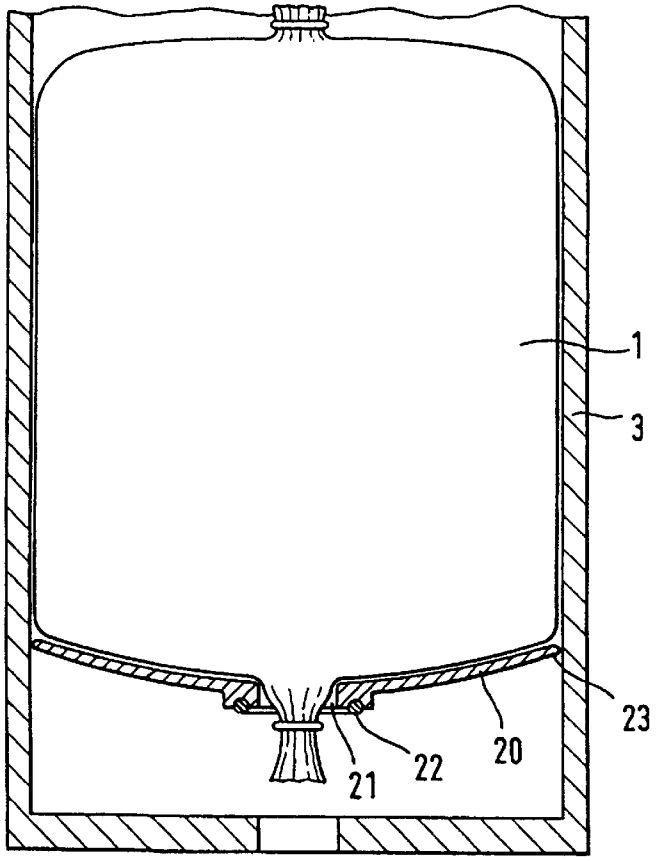

In the embodiment according to FIGS. 5 and 6, the bag 1 is provided with a disc 20 on the discharge side, and this disc 20 carries an O-ring 22 at its centre opening 21, which lets the bag end through. The outside diameter of the disc 20 is slightly larger than the inside diameter of the cartridge wall 3. When the bag with the disc 20 is advanced in the direction of the arrow, the elastically resilient disc is therefore deformed in such a way that its outer rim is supported obliquely against the cartridge wall 3. This inclined position of the rim 23 relative to the cartridge wall 3 is retained even when the disc reaches its end position (FIG. 6). If the piston pressure now ceases, the disc 20 cannot readily give way, since there is a self-locking friction ratio between its rim 23 and the inner surface of the cartridge wall 3. The seal 22 therefore remains pressed against the end face 11 under the elastic force of the disc 20. This applies in principle even if the self-locking effect at the rim 23 of the disc is dispensed with and merely a friction grip of some kind or another is provided between the rim 23 and the cartridge wall 3, the resistance of which friction grip is at least in the same order of magnitude as the force acting during the breathing on the end face of the bag as a result of the back pressure.

Figure 7:
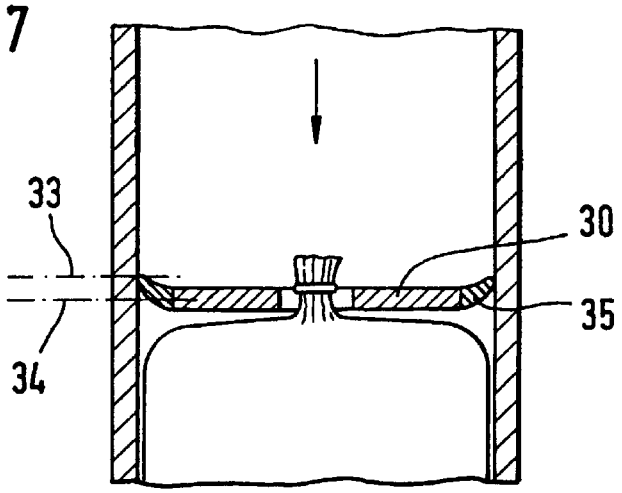
FIG. 7 shows a brake disc at the rear end of the tubular bag.

FIG. 7 shows the arrangement having a brake element attached to the rear end of the tubular bag. Put onto the tubular bag 1 at its end is a disc 30, which, in the centre, contains an opening for receiving the closing cord 31 of the bag. Its circumference interacts in a frictional manner with the inner surface of the cartridge 2. When the tubular bag is pushed into the cartridge in the direction of the arrow from its end remote from the base, the push-in force is transmitted to the bag via the disc 30. The friction force at the circumference of the disc 30 therefore does not have an effect on the internal pressure of the bag 1. If the cartridge with bag contained therein is stored outside the delivery device and is placed in the vertical position with the end 6 downwards, the friction force at the circumference of the disc 30 absorbs the weight of the filled bag 1 and holds it in the existing position.

The circumference of the disc 30 may be provided with features which keep the friction force within a desired range even in the presence of certain dimensional tolerances of the disc 30 and the cartridge 2; for example it may be provided with a friction-increasing elastomeric ring.

An embodiment which, although it sets a friction force of desired magnitude against the reverse movement of the bag, offers only lower resistance to the pushing of the bag into the cartridge from its rear end will be preferred in many cases. Suitable for this purpose are, for example, embodiments in which the plane 33 in which the line of contact between the circumference of the disc 30, serving as brake element, and the inner surface of the cartridge 2 lies is offset rearwards relative to the main plane 34 of the disc. During axial movement of the disc, the friction produces a bending moment at the circumference of the disc, and this bending moment pushes the contact region radially inwards while reducing friction during movement directed into the cartridge and radially outwards while correspondingly increasing friction in the case of the reverse direction of movement.

The circumference of the disc 30, which circumference bears against the inner wall of the cartridge 2, need not be continuous; on the contrary, it may be discontinuous, so that a plurality of flexible arms are formed, the ends of which bear in a flexible manner against the cartridge wall and are connected to one another merely in the central region.

The axial offset between the contact plane 33 and the main plane 34 of the disc 30 or its arms need not be predetermined by the original form of the disc 30; on the contrary, the part may also be of flat design and may not assume the form curved rearwards on the outside until it is elastically deformed when being pushed into the cartridge.

What is claimed is:

1. Arrangement for squeezing out a free-flowing substance, comprising an elongated tubular bag (1), which contains the substance and has, at least at one end, an opening (8) surrounded by a shoulder (12) of the tubular bag (1) and by a sealing ring (13) connected to the shoulder (12) and having or forming at least one sealing element (15, 22, 45), and a squeezing-out device (2, 5), which has a cylinder space (10), which accommodates the tubular bag, receives a pressure piston (5) at one end and contains a discharge opening (9) at the other end, the discharge opening (9) interacting with the bag opening (8) and being surrounded by an end face (11) lying opposite the shoulder (12) of the tubular bag (1) and the sealing ring (13), characterized in that the sealing element (15, 22, 45) of the sealing ring interacts solely with the end face (11) surrounding the discharge opening (9), namely with that edge of the discharge opening which is formed by this end face (11).

2. Arrangement according to claim 1, characterized in that the sealing ring (13) is connected to the bag (1) in such a way as to be movable in an angular manner in relation to the bag axis (42).

3. Arrangement according to claim 2, characterized in that the sealing ring (15) is connected to a disc (16) or is designed as a disc, which is adhesively bonded to the bag end face (12) inside an annular bead (41), which faces the bag end face (12) and whose diameter is substantially smaller than that of the bag (1).

4. Arrangement according to claim 1, characterized in that the sealing surface (46) of the sealing element (45) is of spherical or conical design, and the angle (42) between the tangent applied at the contact point and the centre line (42) is substantially larger than the angle between the direction of the wall (44) of the discharge opening (9) and the centre line (48).

5. Arrangement for squeezing out a free-flowing substance, comprising an elongated tubular bag (1), which contains the substance and has, at least at one end, an opening (8) surrounded by an end face (12) of the tubular bag (1) and by a sealing ring (13) connected to the end face (12) and having or forming at least one sealing element (45), and a squeezing-out device (2, 5), which has a cylinder space (10), which accommodates the tubular bag, receives a pressure piston (5) at one end and contains a discharge opening (9) at the other end, the discharge opening (9) interacting with the bag opening (8) and having a sealing surface (43) interacting with the surface of the sealing ring (13), characterized in that the sealing-ring surface and the sealing surface (43) are spherical.

6. Arrangement according to claim 1, characterized in that the angle (48) between the tangent at the contact point of the sealing surfaces (43, 46) and the centre line (42) is greater than 30°.

7. Arrangement according to claim 1, characterized in that, to centre the bag opening (8) relative to the discharge opening (9), the outside diameter of the annular disc (14) is not much smaller than that of the cylinder space (10).

8. Arrangement according to claim 1, characterized in that the circumferential surface (28) of the sealing ring (13) has a height of at least 4 mm or 6% of the sealing-ring diameter.

9. Arrangement according to claim 1, characterized in that the sealing ring is provided with at least one retaining part arresting it in the sealing position.

10. Arrangement according to claim 9, characterized in that the retaining part is designed as a clamp (23) interacting with the inner wall of the cylinder space.

11. Arrangement according to claim 10, characterized in that the retaining part is designed as at least one suction holder (26) interacting with the end face (11).

12. Arrangement according to claim 1, characterized in that a brake element (30) interacting in a frictional manner with the wall (3) of the cylinder space (10) at least in the direction which leads the bag (1) out of the cylinder space (10) is provided at that end of the bag (1) which is opposite the end containing the opening (8).

13. Arrangement according to claim 12, characterized in that the brake element (30) comprises a disc or a ring, via which the pressure piston (5) acts on the tubular bag.

14. Arrangement according to claim 12, characterized in that the circumference, if need be discontinuous, of the brake element (30) has a diameter which is larger than the inside diameter of the cylinder space (10).

15. Arrangement according to claim 12, characterized in that the plane (33) of contact between the brake element (30) and the wall (3) of the cylinder space (10) is offset in the direction away from the tubular bag (1) relative to that plane (34) of the region of the brake element which bears against the tubular bag (1).

16. Arrangement for squeezing out a free-flowing substance, comprising an elongated tubular bag (1), which contains the substance and has, at least at one end, an opening (8) surrounded by an end face (12) of the tubular bag (1) and by a sealing ring (13) connected to the end face (12) and having or forming at least one sealing element (45), and a squeezing-out device (2, 5), which has a cylinder space (10), which accommodates the tubular bag, receives a pressure piston (5) at one end and contains a discharge opening (9) interacting with the bag opening (8) and having a sealing surface (43) interacting with the surface of the sealing ring (13), characterized in that the sealing-ring surface or the sealing surface (43) is spherical.

* * * * *